US006485555B1

(12) United States Patent
Lindgren et al.

(10) Patent No.: US 6,485,555 B1
(45) Date of Patent: Nov. 26, 2002

(54) SIZING COMPOSITION

(75) Inventors: Erik Lindgren, Bohus (SE); Sten Frölich, Askim (SE); Rein Sikkar, Floda (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/959,022

(22) PCT Filed: Mar. 30, 2000

(86) PCT No.: PCT/SE00/00622

§ 371 (c)(1),
(2), (4) Date: Dec. 21, 2001

(87) PCT Pub. No.: WO00/63493

PCT Pub. Date: Oct. 26, 2000

Related U.S. Application Data

(60) Provisional application No. 60/129,410, filed on Apr. 15, 1999.

(30) Foreign Application Priority Data

Apr. 15, 1999 (EP) ..... 99850064
Mar. 30, 2000 (SE) ..... 0000622

(51) Int. Cl.[7] ..... C07G 17/00; C08H 5/00; C09K 3/00; D21F 11/00; D21H 23/00

(52) U.S. Cl. ..... 106/287.3; 106/287.23; 106/287.25; 106/287.29; 162/164.6; 162/158; 162/135; 162/164.1; 162/167

(58) Field of Search ..... 524/589; 106/287.23, 106/287.25, 287.29, 287.3; 162/164.6, 158, 135, 164.1, 167

(56) References Cited

U.S. PATENT DOCUMENTS 3,887,427 A 6/1975 Helmer et al. ..... 162/158
4,522,686 A 6/1985 Dumas ..... 162/158
4,743,303 A 5/1988 Helmer et al. ..... 106/236
4,935,096 A 6/1990 Gallagher et al. ..... 162/5
5,176,748 A 1/1993 Nikoloff et al. ..... 106/211

FOREIGN PATENT DOCUMENTS

EP 220 941 5/1987 ..... D21H/3/02
EP 707 110 4/1996 ..... D21H/17/16
JP 53-027649 3/1978 ..... D21H/1/40
JP 57-167492 10/1982 ..... D21H/3/02

OTHER PUBLICATIONS

Derwent Abstract 003474579 (1982), abstracting JP 56148998.

Derwent Abstract 003437284 (1982), abstracting JP 57–167492.

Derwent Abstract 002017855 (1978), abstracting JP 53–027649.

Ullman's Encyclopedia of Industrial Chemistry, 5 Edition, vol. A25, pp. 783–793.

Kirk Othmer Encyclopedia of Chemical Technology, 4 Edition, vol. 23, pp. 506–523.

International Search Report, dated Jul. 21, 2000.

*Primary Examiner*—Patrick D. Niland
(74) *Attorney, Agent, or Firm*—Lainie E. Parker

(57) ABSTRACT

The present invention relates to sizing of paper and more specifically to a substantially water-free and aqueous composition of a sizing agent where the composition contains a cellulose reactive sizing agent, a cationic compound with a molecular weight up to 10000 and a non-ionic compound. Additionally, the invention relates to the preparation and use of above-mentioned compositions.

12 Claims, No Drawings

SIZING COMPOSITION

This application is a 371 of PCT/SE00/00622 filed Mar 30, 2000 which claims benefit of Provisional Application Ser. No. 60,129,410 filed Apr. 15, 1999.

The present invention relates to sizing of paper and more specifically to substantially water-free compositions and aqueous compositions of cellulose-reactive sizing agents, their preparation and use.

BACKGROUND

Cellulose-reactive sizing agents, such as those based on alkyl ketene dimer (AKD) and alkenyl succinic anhydride (ASA), are widely used in papermaking at neutral or slightly alkaline stock pH's in order to give paper and paper board some degree of resistance to wetting and penetration by aqueous liquids. Paper sizes based on cellulose-reactive sizing agents are generally provided in the form of dispersions containing an aqueous phase and finely divided particles or droplets of the sizing agent dispersed therein. The dispersions are usually prepared with the aid of dispersing agents consisting of an anionic compound, e.g. sodium lignosulfonate, preferably in combination with a high molecular weight amphoteric or cationic polymer, e.g. cationic starch, polyamine, polyamideamine or a vinyl addition polymer. However, dispersions of these types usually exhibit rather poor stability and high viscosity, even at relatively low solids contents, which evidently lead to difficulties in handling the dispersions, for example on storage and in use. A further drawback is that the products have to be supplied as low concentration dispersions which further increases the costs of transportation of the active sizing agent as well as the cost for storage due to the large volume occupied by the aqueous content of common dispersions.

U.S. Pat. No. 5,176,748 refers to a sizing composition containing ASA, a cationic soluble dispersing agent and optionally a non-ionic surfactant. The cationic dispersing agents used are high molecular cationic dispersing agent such as diallyl dimethyl ammonium chloride (Polydadmac) having molecular weights of around 50,000.

EP 220941 A1 relates to a solid composition comprising ketene dimers, an encapsulating agent such as polyethers and a cationic polymer such as polyamines.

U.S. Pat. No. 4,743,303 discloses aqueous dispersions of rosin and synthetic sizing agents comprising non-ionic surface active agents and cationic dispersing agents.

EP 707110 A1 relates to an alkenylsuccinic emulsion sizing agent comprising an emulsifier and/or an anionic high-molecular weight stabiliser.

Before usage of the compositions they are emulsified in the presence of an aqueous phase. In order to reduce the particle size shear forces are required. One advantage of the present invention is therefore to improve emulsification/dispersing properties. Yet another advantage of the present invention is to achieve good and/or improved sizing while using a substantially water-free sizing composition which disperses easy/fast in an aqueous phase. Furthermore the problem of stability relating to the usual sizing dispersions is circumvented by providing a sizing composition which is essentially water-free. Further objects will appear hereinafter.

The Invention

In accordance with the present invention it has been found that improved homogenisation can be obtained with an essentially water-free composition according to the claims. More specifically, the invention relates to an essentially water-free composition of a cellulose-reactive sizing agent comprising a non-ionic compound and a cationic compound with a molecular weight of up to 10,000 which are effective as dispersing agents. The size compositions of this invention are easily homogenised thus minimising the use of shear forces. In addition, the present invention relates to an aqueous composition of a cellulose-reactive sizing agent and their preparation and use, as further defined in the claims.

The present composition makes it possible to reduce transportation costs by virtually excluding the amount of water usually present in dispersion. The present invention thus offers substantial economic and technical benefits.

By aqueous composition is also meant an aqueous dispersion of a cellulose reactive sizing agent. Accordingly, an aqueous dispersion or an aqueous composition is obtained by emulsification or homogenisation of the substantially water-free composition of a sizing agent.

The cellulose-reactive sizing agent according to the invention can be selected from any of the cellulose-reactive sizing agents known in the art. Suitably the sizing agent is selected from the group consisting of hydrophobic ketene dimers, ketene multimers, acid anhydrides, organic isocyanates, carbamoyl chlorides and mixtures thereof, preferably ketene dimers and acid anhydrides, most preferably ketene dimers. Suitable ketene dimers have the general formula (I) below, wherein $R^1$ and $R^2$ represent saturated or unsaturated hydrocarbon groups, usually saturated hydrocarbons, the hydrocarbon groups suitably having from 8 to 36 carbon atoms, usually being straight or branched chain alkyl groups having 12 to 20 carbon atoms, such as hexadecyl and octadecyl groups. Suitable acid anhydrides can be characterized by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, optionally being further substituted with hydrocarbon groups containing up to 30 carbon atoms. Examples of acid anhydrides which are used commercially include alkyl and alkenyl succinic anhydrides and particularly isoocta-decenyl succinic anhydride.

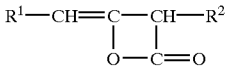

(I)

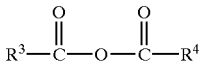

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

In addition to the cellulose-reactive sizing agent, the size dispersions may also contain a non-cellulose-reactive sizing agent. Examples of suitable sizing agents of this type include rosins, e.g. fortified and/or esterified rosin, waxes, fatty acid and resin acid derivatives, e.g. fatty amides and fatty esters, e.g. glycerol triesters of natural fatty acids.

The cationic compound comprised in the present invention preferably contains one or more cationic groups of the same or different types and include cationic compounds having one cationic group and cationic compounds having two or more cationic groups, i.e. cationic polyelectrolytes. Examples of suitable cationic groups include sulfonium groups, phosphonium groups, acid addition salts of primary, secondary and tertiary amines or amino groups and quaternary ammonium groups, for example where the nitrogen has been quaternized with methyl chloride, dimethyl sulfate or benzyl chloride, preferably acid addition salts of amines/amino groups and quaternary ammonium groups. Cationic polyelectrolytes can have a degree of substitution varying over a wide range; the degree of cationic substitution ($DS_C$) can be from 0.01 to 1.0, suitably from 0.1 to 0.8 and preferably from 0.2 to 0.6.

Suitable cationic organic compounds for use in this invention include cationic compounds capable of functioning as a surfactant and/or dispersing agent. Preferably the cationic compound is a surfactant. The cationic surfactant can be selected from primary, secondary, tertiary, and quaternary ammonium compounds containing at least one hydrocarbon group with from 9 to 30 carbon atoms. Further preferred cationic surfactants include compounds having the general formula $R_4N^+X^-$, wherein each R group is independently selected from (i) hydrogen; (ii) hydrocarbon groups, suitably aliphatic and preferably alkyl groups, having from 1 to about 30 carbon atoms, preferably from 1 to 22 carbon atoms; and (iii) hydrocarbon groups, suitably aliphatic and preferably alkyl groups, having up to about 30 carbon atoms, preferably from 4 to 22 carbon atoms, and being interrupted by one or more heteroatoms, e.g. oxygen or nitrogen, and/or groups containing a heteroatom, e.g. carbonyl and acyloxy groups; where at least one, suitably at least three and preferably all of said R groups contain carbon atoms; suitably at least one and preferably at least two of said R groups containing at least 7 carbon atoms, preferably at least 9 carbon atoms and most preferably at least 12 carbon atoms; and wherein $X^-$ is a counter-ion, typically a halide like chloride, or a group present in the counter-ion compound of the dispersant, e.g. where the surfactant is a protonated amine of the formula $R_3N$ wherein R and N are as defined above. Examples of suitable surfactants include dioctyl-dimethylammonium chloride, didecyldimethylammonium chloride, dicocodimethylammonium chloride, cocobenzyldimethylammonium chloride, coco(fractionated)-benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethyl-ammonium chloride, and di(ethylene hexadecanecarboxylate)dimethylammonium chloride. Particularly preferred cationic surfactants thus include those containing at least one hydrocarbon group with from 9 to 30 carbon atoms and notably quaternary ammonium compounds.

Further preferred cationic surfactants include quaternary di- and polyammonium compounds containing at least one hydrocarbon group, suitably aliphatic and preferably alkyl, with from 9 to 30 carbon atoms, preferably from 12 to 22 carbon atoms. Examples of suitable surfactants of this type include N-octadecyl-N-dimethyl-N'-trimethyl-propylenediammonium dichloride.

Preferred cationic polyelectrolytes used in the present invention further include low molecular weight cationic organic polymers, optionally degraded, e.g. those derived from polysaccharides like starches and guar gums, cationic condensation products like cationic polyurethanes, polyamideamines, e.g. polyamideamine-epichlorohydrin copolymers, polyamines, e.g. dimethylamine-epichlorohydrin copolymers, dimethylamine-ethylenediamine-epichlorohydrin copolymers, ammonia-ethylenendichloride copolymers, vinyl addition polymers formed from monomers with cationic groups, e.g. homopolymers and copolymers of diallyldimethylammonium chloride, dialkylaminoalkyl acrylates, methacrylates and acrylamides (e.g. dimethylaminoethyl acrylates and methacrylates) which usually are present as acid addition salts or quaternary ammonium salts, optionally copolymerized with non-ionic monomers including acrylamide, alkyl acrylates, styrene and acrylonitrile and derivatives of such monomers, vinyl esters, and the like.

The molecular weight of the cationic organic compound generally are up to about 10,000, usually up to about 5,000, suitably up to about 3,000 and preferably up to about 800. The molecular weight is usually at least about 200. Suitable cationic surfactants may have a molecular weight up to about 3,000 and preferred cationic surfactants have a molecular weight between about 200 and about 800.

Suitable non-ionic compounds for use in this invention include non-ionic compounds functioning as surfactants and/or dispersing agents. The non-ionic compounds are usually polyalkylene oxide ethers or polyalkylene oxide esters or mixtures thereof. Suitably, the non-ionic compounds comprise a polyalkylene oxide moiety and an aliphatic moiety. The polyalkylene oxide moiety of the non-ionic compound can contain one or different alkylene oxide unit. Suitably the non-ionic compound comprise at least 3 alkylene oxide units, preferably from 4 up to 100 and more preferably from 5 up to 60 alkylene oxide units and most preferably from 5 up to 50 alkylene oxide units. Common alkylene oxide units are ethylene oxide or propylene oxide. The aliphatic moiety of the non-ionic compound, usually linked by an ester or an ether group to the polyalkylene oxide moiety is suitably branched, linear and or cyclic. Usually, the aliphatic moiety is an alkyl or an alkenyl group containing at least 4 carbon atoms. Suitable non-ionic compound are ethoxylated fatty ethers, ethoxylated fatty esters or ethoxylated nonylphenols or silicone glycol polymers are examples of compounds which can be used in this invention. Further examples of preferred non-ionic compound used in the present invention are disclosed in Ullman's Encyclopaedia of Industrial Chemistry, 5 Edition, Voume A25, pages 783–793; Kirk Othmer Encyclopaedia of Chemical Technology, 4 Edition, Volume 23, pages 506–523 and Handbook of industrial surfactants, second edition 1997, Gower Publishing Limited, which are all hereby incorporated by reference.

The amount of cationic and non-ionic compounds present in the substantially water-free composition and aqueous composition according to the invention can be varied over a broad range depending on, among other things, type and charge density of the cationic and non-ionic materials, type of sizing agent, desired cationicity and solids content of the resulting dispersion. In the substantially water-free composition and aqueous composition the cationic compound can be present in an amount of up to 100% by weight, usually from 0.1 to 20% by weight, suitably from 1 to 10% by weight and preferably from 2 to 7% by weight, based on the sizing agent, and the non-ionic compound can be present in an amount of up to 100% by weight, usually from 0.1 to 20% by weight, suitably from 0.2 to 10% by weight and preferably from 0.3 to 6% by weight, based on the sizing agent.

According to the present invention the sizing composition is substantially water-free. By substantially water-free is usually meant that a small amount of water can be present; the water content can be from 0 up to 10% by weight, suitably less than 5% by weight and preferably less than 2%. Most preferably the composition is free from water.

According to a preferred embodiment of the present invention the substantially water-free composition is essentially free from rosins and/or derivatives of rosins. By essentially free is meant that the aqueous composition obtained after dispersing the essentially water-free composition contains less than 5 weight % of rosins and/or derivatives of rosins, suitably less than 2 weight %. More preferably, the substantially water-free composition is free from rosins and/or derivatives of rosins.

The composition preferably contains the cellulose-reactive sizing agent in a predominant amount, based on weight, suitably at least 50% by weight, and suitably the composition has sizing agent content within the range of from 80 to 99.8% by weight and preferably from 90 to 99.7% by weight.

According to the present invention an aqueous composition of a cellulose-reactive sizing agent is provided comprising a cationic compound with a molecular weight up to 10,000 and a non-ionic compound. The aqueous compositions of the invention can be prepared in high solids contents and yet exhibit very good stability on storage and low viscosity. Accordingly, this invention provides size dispersions with good and/or improved storage stability, higher solids content and/or lower viscosity. A further benefit observed with the present aqueous composition is very good and/or improved dilute stability which means low aggregation of the particles or droplets of sizing agent, thereby forming lower levels of bigger aggregates having lower sizing efficiency, as well as low deposition of the hydrophobic sizing agent on the paper machine and less wire contamination, thereby reducing the need for maintenance of the paper machine. The present aqueous compositions generally can have sizing agent contents of from about 1 to about 60%. Compositions containing a ketene dimer sizing agent according to the invention may have ketene dimer contents within the range of from 5 to about 50% by weight and preferably from about 10 to about 35% by weight. Dispersions, or emulsions, containing an acid anhydride sizing agent according to the invention may have acid anhydride contents within the range from 0.1 to about 30% by weight and usually from about 1 to about 20% by weight.

It has further surprisingly been found that the essentially water-free composition of a cellulose-reactive sizing agent according to the present invention easily can be homogenised in the presence of an aqueous phase. Less energy and lower shear forces are required in this process compared to processes for preparing conventional dispersions and hereby simplified equipment can be employed. The substantially water-free composition according to the invention can be produced by melting the sizing agent and adding the non-ionic compound and the cationic compound thereto. According to yet another preferred embodiment, the substantially water-free composition can be produced by melting the sizing agent and adding the cationic compound. The so formed composition is then suitably emulsified in the presence o fan aqueous phase comprising the non-ionic compound. After cooling the melt solid pellets are formed. The aqueous composition or dispersion of a sizing agent can be obtained by heating a water phase suitably up to a temperature where the sizing agent is present in liquid form, preferably from about 20° C. up to 95° C. Accordingly, another preferred embodiment of the present invention refers to a method for the preparation of an aqueous dispersion of a cellulose-reactive sizing agent where the substantially water-free composition is emulsified in the presence of an aqueous phase. Yet another preferred embodiment of the present invention is a method for the preparation of an aqueous dispersion of a cellulose-reactive sizing agent where a substantially water-free sizing composition comprising a cellulose-reactive sizing agent and a cationic compound with a molecular weight of up to 10,000 is emulsified in the presence of an aqueous phase containing a non-ionic compound. The substantially water-free composition of the invention is suitably added to the aqueous phase at an amount to give an aqueous composition or dispersion with a sizing agent content within the range of from about 0.1 up to about 90% by weight preferably from about 0.1 up to about 50% by weight. After the addition of the composition to the aqueous phase the formed aqueous composition preferably is emulsified, suitably under pressure, whereby a dispersion is formed. The size composition is preferably emulsified at the location of intended use, or elsewhere. This method is especially attractive when preparing emulsions of ketene dimers. The provision of a storage-stable substantially water-free size composition thus offers considerable economic and technical benefits. The substantially water-free sizing composition is suitably formulated as pellets which can have various shapes.

The components that are present in the composition according to the invention, i.e., the cellulose-reactive sizing agent, the cationic compound and the non-ionic compound, preferably are defined as above.

The compositions and dispersions according to the invention can be used in conventional manner in the production of paper using any type of cellulosic fibres and they can be used both for surface sizing and internal or stock sizing. The term "paper", as used herein, is meant to include not only paper but all types of cellulose-based products in sheet and web form, including, for example, board and paperboard. The stock contains cellulosic fibres, optionally in combination with mineral fillers, and usually the content of cellulosic fibres is at least 50% by weight, based on dry stock. Examples of mineral fillers of conventional types include kaolin, china clay, titanium dioxide, gypsum, talc and natural and synthetic calcium carbonates such as chalk, ground marble and precipitated calcium carbonate. The present invention also relates to a method for the production of paper in which an aqueous dispersion, as defined above, is used as a surface or stock size. Suitably the amount of cellulose-reactive sizing agent either added to the stock containing cellulosic fibres, and optional fillers, to be drained on a wire to form paper, or applied on the paper surface as a surface size, usually at the size press, is from 0.01 to 1.0% by weight, based on the dry weight of cellulosic fibres and optional fillers, preferably from 0.05 to 0.5% by weight, where the dosage is mainly dependent on the quality of the pulp or paper to be sized, the cellulose-reactive sizing agent used and the level of sizing desired.

Chemicals conventionally added to the stock in papermaking such as retention aids, aluminium compounds, dyes, wet-strength resins, optical brightening agents, etc., can of course be used in conjunction with the present compositions. Examples of aluminium compounds include alum, aluminates and polyaluminium compounds, e.g. polyaluminium chlorides and sulphates. Examples of suitable retention aids include cationic polymers, anionic inorganic materials in combination with organic polymers, e.g. bentonite in combination with cationic polymers, silica-based sols in combination with cationic polymers or cationic and anionic polymers. Particularly good stock sizing can be obtained when using the aqueous compositions or dispersions of the invention in combination with retention aids comprising cationic polymers. Suitable cationic polymers include cationic starch, guar gum, acrylate-based and acrylamide-based polymers, polyethyleneimine, dicyandiamide-formaldehyde resins, polyamines, polyamidoamines and poly (diallyldimethyl ammonium-chloride) and combinations thereof. Cationic starch and cationic acrylamide-based polymers are preferably used, either alone or in combination with each other or with other materials. In a preferred embodiment of the invention, the dispersions are used in combination with a retention system comprising at least one cationic polymer and anionic silica-based particles. The present aqueous compositions or dispersions can be added before, between, after or simultaneously with the addition of the cationic polymer or polymers. It is also possible to pre-mix the size dispersion obtained by homogenisation of the essentially water-free composition with a retention aid, e.g. a cationic polymer like cationic starch or a cationic acrylamide-based polymer, or an anionic silica-based material, prior to introducing the mixture thus obtained into the stock. Accordingly, the aqueous composition or dispersion can be prepared just prior to introducing it into the stock by emulsifying a substantially water-free size composition according to the invention with an aqueous solution.

The invention is further illustrated in the following examples, which, however, are not intended to limit the same. Parts and % relate to parts by weight and % by weight, respectively, unless otherwise stated.

EXAMPLE 1

Sizing effiency of an aqueous size composition according to the invention was evaluated in this example. A dispersion of AKD was prepared by melting 94,5 grams of AKD with 4.0 grams of cationic amine (di(hydrogenated tallow) dimethylammonium chloride, Querton 442 Akzo Nobel trade name) and 1.5 grams of a non-ionic compound (polyethylene oxide alkyl having 7 ethylene oxide units and alkyl moiety containing 11 carbon atoms, Berocell 537). The melt was solidified to form pellets. 50 grams of these pellets were added to water at 60° C. and melted. An Ultra Turrax mixer at 15,000 rpm was used for 60 seconds to prepare the dispersion. Paper sheets were prepared according to the standard method SCAN-C23X for laboratory scale. The papermaking stock used contained 80% of bleached birch and 20% chalk to which 0.3 g/l $Na_2SO_4$*10 $H_2O$ was added. Stock consistency was 0.5% and pH 8.0. The size dispersion was used in conjunction with a commercial retention and dewatering system, Compozil™, comprising cationic starch and an anionic aluminium-modified silica sol which were added to the stock separately; the cationic starch was added in an amount of 7 kg/ton, based on dry stock, and the silica sol was added in an amount of 0.8 kg/ton calculated as $SiO_2$ and based on dry stock. Cobb value, measured according to TAPPI standard T441 OS-63, obtained in the tests was 17 g/m2 at an addition level of AKD of 0.6 kg/ton calculated on dry stock. This Cobb value indicates a good sizing of the paper using the sizing compositions according to this invention.

EXAMPLE 1

Ease of manufacture of dispersions according to the invention was evaluated by preparing aqueous dispersions from substantially water-free sizing compositons. Dispersions of the invention were prepared by a) emulsifying substantially water-free compositions of AKD (alkyl ketene dimer) containing a cationic amine (di(hydrogenated tallow) dimethylammonium chloride, Querton 442, Akzo Nobel) and varying amounts of a non-ionic compound (polyethylene oxide alkyl having 7 ethylene oxide units and alkyl moiety containing 11 carbon atoms, Berocell 537) (tests C1–C3) b) emulsifying substantionally water-free compositions of AKD containing the cationic amine whereby different amounts of non-ionic compound were added to the aqueous phase before emulsification. Reference substantially water-free sizing compositions according to prior art was evaluated comprising AKD, and cationic amine (A and B). The AKD-wax was for the invention mixed with 2,4 weight % based on AKD of the cationic amine and 1, 2 and 3 weight % based on AKD of the non-ionic compound. In tests C1–C3 the non-ionic compound was contained in the substantially water-free sizing composition. In tests D1–D3 the non-ionic compound was present in the aqueous phase. In test E a substantially water-free sizing composition was evaluated containing AKD, 0,9 weight % based on AKD of a non-ionic compound containing about 56 propylene oxide and ethylene oxide units (Pluronic PE 10500) and 0,4 weight % based on AKD of Polydadmac FL45C with a molecular weight of about 200,000 to 500,000. The composition was subsequently dispersed in an aqueous phase.

The substantially water-free AKD compositions were made by melting the AKD adding the cationic amine and the non-ionic compound or adding only the cationic amine and thereafter cooling the melt and forming solid pellets. The reference compositions according to the prior art were made of pellets containing the cationic amine and AKD which subsequently were emulsified in the presence of an aqueous phase containing sodium naphtalene sulphonate (A) or which were emulsified in the presence of an aqueous phase containing no sodium naphtalene sulphonate (B).

The preparation of the dispersions was made by heating the aqueous phase to about 70° C. and adding to the aqueous phase substantially water-free AKD compositions in form of pellets. After the addition a mixer, Ultra Turrax with a speed of 15000 rpm, was used for the homogenisation/emulsification. Mixing times were varied between 5 to 180 seconds. The particle size was measured by a Malvern Mastersizer.

TABLE 1

| Dispersing times | A | B | C1 | C2 | C3 | D1 | D2 | D3 | E |
|---|---|---|---|---|---|---|---|---|---|
| 5 | 15 | >100 | 8.6 | 7.3 | 7.3 | 7.7 | 8.6 | 5.7 | 4.4 |
| 15 | 6.8 | 7.5 | 5.6 | 5.7 | 4.8 | 5.3 | 4.9 | 4.3 | 5.6 |
| 30 | 4.8 | 5.2 | 4.3 | 4.1 | 2.3 | 4.6 | 3.9 | 3.2 | 3.3 |
| 60 | 3.7 | 3.5 | 3.0 | 1.9 | 1.2 | 2.9 | 2.5 | 1.4 | 4.1 |
| 180 | 1.1 | 0.8 | 1.0 | 0.9 | 0.7 | 1.3 | 0.8 | 0.7 | 4.5 |

Particle size is in microns for 50% volume.

Table 1 demonstrates that by adding a non-ionic surfactant to the aqueous phase or to the AKD pellets, a reduction in the particle size is achieved much faster thus reducing the needed time and energy for forming a dispersion. For E a fast decrease in particle size was achieved, however, the particles were never smaller than 3,3 microns which is not acceptable.

What is claimed is:

1. A substantially water-free composition of a cellulose-reactive sizing agent, the cellulose-reactive sizing agent being a ketene dimer sizing agent, said composition further comprising a cationic surfactant having a molecular weight up to about 10,000 selected from primary, secondary, tertiary or quaternary ammonium compounds containing at least one hydrocarbon group with from 9 up to 30 carbon atoms, and a non-ionic compound comprising a polyalkylene oxide moiety and an aliphatic moiety, said composition being essentially free from rosins and derivatives of rosins.

2. The substantially water-free composition according to claim 1, wherein the cationic surfactant is present in an amount of from 0.1 to 20% by weight, based on the sizing agent, and the non-ionic compound is present in an amount of from 0.1 to 20% by weight, based on the sizing agent.

3. The substantially water-free composition according to claim 1, wherein the cationic surfactant has a molar weight of from 200 to 800.

4. The substantially water-free composition according to claim 1, wherein the cationic surfactant is selected from dioctyldimethylammonium chloride, didecyldimethylammonium chloride, dicocodimethylammonium chloride, cocobenzyldimethylammonium chloride, coco(fractionated) benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethylammonium chloride, di(ethylene hexadecanecarboxylate) dimethylammonium chloride, and N-octadecyl-N-dimethyl-N'-trimethyl-propylene-diammonium dichloride.

5. A method for the preparation of an aqueous dispersion of a cellulose-reactive sizing agent comprising dispersing in water the composition according to claim 1.

6. A method for the preparation of an aqueous dispersion of a cellulose-reactive sizing agent characterised in that a substantially water-free sizing composition comprising a cellulose-reactive sizing agent and a cationic compound with a molecular weight of up to 10,000 is emulsified in the presence of an aqueous phase containing a non-ionic compound.

7. A method for the production of paper comprising adding a stock sizing agent or surface sizing agent which includes a composition according to claim 1.

8. A process for the production of paper comprising adding the substantially water-free composition of claim 1 to a stock containing cellulosic fibres and optional fillers, and dewatering the stock on a wire to obtain paper and white water.

9. The substantially water-free composition according to claim 1, wherein the ketene dimer sizing agent is present in an amount of at least 50% by weight.

10. The substantially water-free composition according to claim 1, wherein the cationic surfactant is selected from surfactants having the general formula $R_4N^+X^-$, wherein each R group is independently selected from (i) hydrogen; (ii) hydrocarbon groups having from 1 to about 30 carbon atoms; and (iii) hydrocarbon groups having up to about 30 carbon atoms being interrupted by one or more hetero atoms and/or groups containing a hetero atom, wherein at least one of the R groups contains 9–30 carbon atoms.

11. The substantially water-free composition according to claim 1, wherein the non-ionic compound comprises a polyalkylene oxide moiety having from 5 up to 60 alkylene oxide units and an aliphatic moiety linked by an ether or ester group to the polyalkylene oxide moiety, wherein the aliphatic moiety is an alkyl or alkenyl group comprising at least 4 carbon atoms.

12. A method for the preparation of an aqueous dispersion from the substantially water-free composition of claim 1, wherein the substantially water-free composition is emulsified in the presence of an aqueous phase.

* * * * *